United States Patent [19]

Raudat

[11] Patent Number: 4,459,794

[45] Date of Patent: Jul. 17, 1984

[54] ACCELERATED LOADING FOR CASE PACKER

[75] Inventor: John L. Raudat, North Madison, Conn.

[73] Assignee: Standard-Knapp, Inc., Portland, Conn.

[21] Appl. No.: 269,376

[22] Filed: Jun. 1, 1981

[51] Int. Cl.[3] ..... B65B 21/16

[52] U.S. Cl. ..... 53/497; 53/247; 198/577

[58] Field of Search ..... 53/247, 248, 495, 496, 53/497; 198/577

[56] References Cited

U.S. PATENT DOCUMENTS

| | | | |
|---|---|---|---|
| 3,201,912 | 8/1965 | Wozniak | 53/495 |
| 3,608,694 | 9/1971 | Schlueter et al. | 53/497 |
| 3,727,366 | 4/1973 | Schlueter et al. | 53/497 |
| 4,300,330 | 11/1981 | Hartness | 53/247 X |

*Primary Examiner*—James F. Coan

*Attorney, Agent, or Firm*—McCormick, Paulding & Huber

[57] ABSTRACT

An infeed conveyor drive has a speed pulse selectively applied thereto when the line brakes release articles held back on the conveyor for movement into a case packer grid. One way clutches couple the conveyor to a variable speed drive unit for producing a speed pulse of any desired magnitude.

4 Claims, 7 Drawing Figures

ACCELERATED LOADING FOR CASE PACKER

This invention relates generally to case packing apparatus, and deals more particularly with means for accelerating the articles as they move into the grid portion of the apparatus by virture of a speed pulse selectively applied to the infeed conveyor.

In a typical case packer apparatus the articles awaiting delivery to the grid are held back on a deadplate such that the infeed conveyor continues to operate and to slide relative to the bottoms of the articles held back by conventional line brake means associated with the deadplate. At a predetermined point in the cycle of the case packer the articles are released for advancement into the grid, following which they are deposited into an upwardly open packing case in a conventional manner. The general object of the present invention is to provide a convenient means for imposing a speed pulse on the infeed conveyor such that the articles are gradually acceleterated from the normal speed of operation of the infeed conveyor to a maximum speed and then returned again to the normal speed prior to the time when the articles fill the grid. The improved apparatus to be described also provides for variations in this speed pulse to accommodate groups or slugs of articles of various linear dimension, and provides for minimizing the time or portion of the cycle required for loading articles into the grid all without exceeding the physical limits imposed by the necessity for slipping between the articles held back on the infeed conveyor and the infeed conveyor itself. Also achieved in the preferred embodiment is the further advantage that the articles will not only be accelerated for loading, but will also be decelerated prior to the time when the articles in the grid reach positions in the grid at which they are stopped, as for example when the endmost articles engage the lane detectors normally provided in such a grid structure.

In accomplishing the foregoing objects of the present invention a preferred form of apparatus for the accelerated loading of a case packer comprises a conventional grid taken in combination with an infeed conveyor having a deadplate provided therebetween. Means is provided for selectively holding back articles on the deadplate and correspondingly articles on the infeed conveyor, and the grid includes means for achieving the desired cycle of operation such that charges or slugs of articles are deposited into upwardly open packing cases provided for the grid on a lift table or the like. The drive means provided for the infeed conveyor operates at some predetermined normal speed low enough to prevent damage when the articles are started up from rest by release of the holdback means or stopped as a result of engagement between the endmost article and the lane detectors in the grid itself. A variable speed drive unit has an output shaft coupled to the infeed conveyor through a one-way clutch. The input shaft for this variable speed drive unit is coupled to the infeed conveyor drive means, and a single revolution clutch provides a convenient means for imposing the speed pulse on the infeed conveyor at the desired point during the machine cycle. A second one-way clutch couples the drive means directly to the infeed conveyor and means is preferably provided in response to release of the article holdback means on the deadplate in order to cause the single revolution clutch to so couple the variable speed drive output shaft to the infeed conveyor that the above listed advantages are achieved.

In the drawings:

FIG. 1 illustrates in schematic fashion the environment for the present invention at the start of a particular cycle for the case packer apparatus.

FIG. 2 is similar to FIG. 1 but shows the packer at a slightly latter instant of time, and FIG. 3 shows the same apparatus at a still latter instant of time wherein the group of articles in the grid is being dropped into an upwardly open packing case provided on a lift table associated with the apparatus itself.

Figure 4:
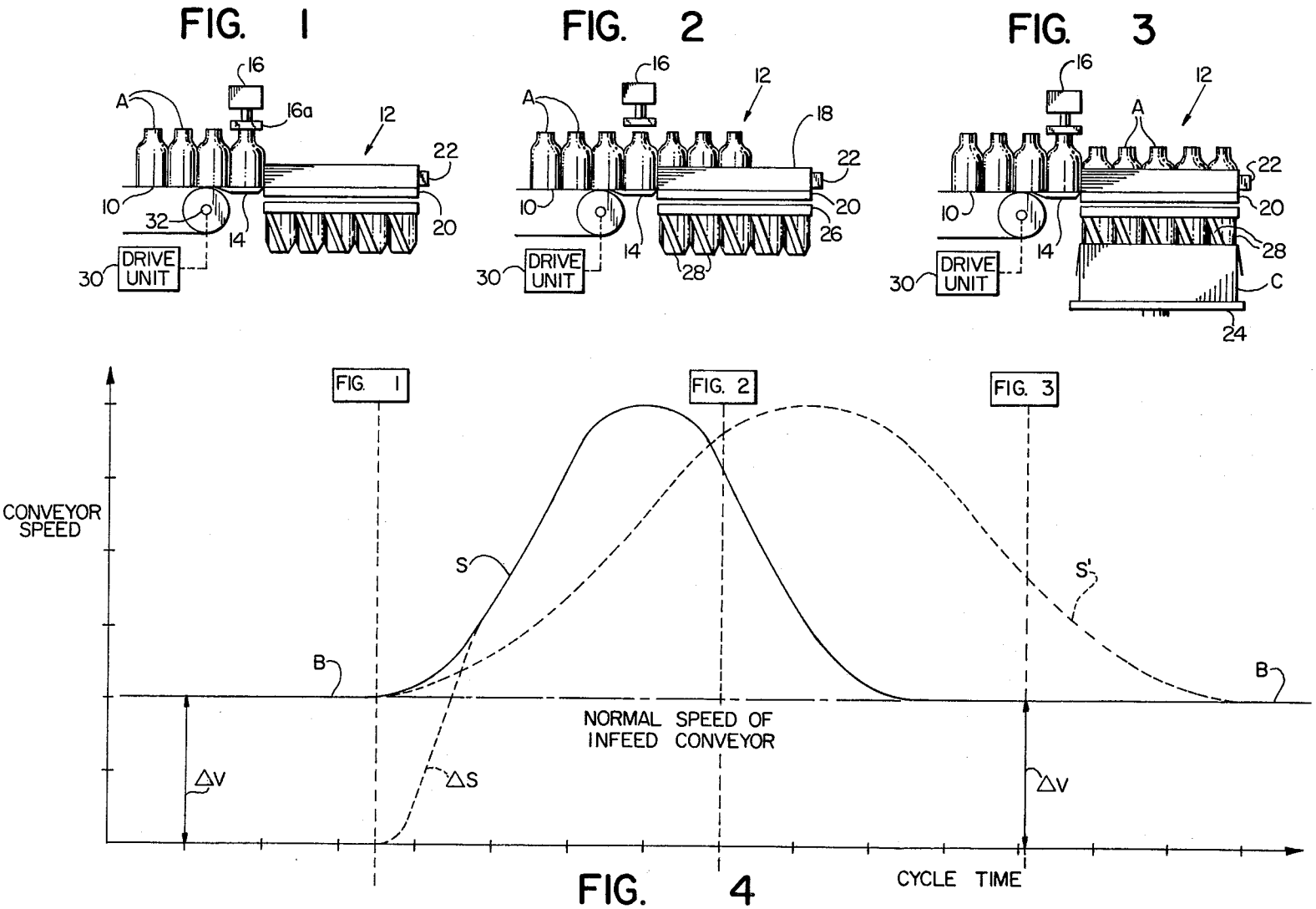
FIG. 4 illustrates variations of infeed conveyor speed with time during a particular cycle of operation of the grid type packer illustrated in FIGS. 1–3.

Turning now to the drawings in greater detail, FIG. 1 shows an infeed conveyor 10 of the type which is adapted to be continuously operated in a direction for feeding articles A, A from left to right as viewed in FIG. 1 for purposes of loading these articles in orderly lanes into a grid structure indicated generally at 12 in FIG. 2. The articles A, A are adapted to be selectively held back on a deadplate 14 provided between the downstream end of the conveyor 10 and the grid structure 12. FIG. 1 shows the holdback means in the form of selectively operated line brakes 16 for clamping an article A between a pad **16*a* and the deadplate 14 in order to holdback the articles A, A on the infeed conveyor. Release of the line brake 16 as suggested in FIG. 2 permits the articles A, A to be fed by the infeed conveyor 10 in the downstream direction for loading the grid structure 12. The grid structure 12 includes an upper grid portion in the form of lane dividers 18 such that the articles can move along riding strips 20 in each of these lanes until contact is made with conventional lane detector means shown generally at 22. In a typical case packer triggering of the lane detectors 22 will set the line brakes 16 as suggested in FIG. 3 so that the charge or slug of articles received in the upper portion of the grid can be deposited into an upwardly open packing case C provided for this purpose on a lift table 24. In the apparatus shown in FIG. 1–3 inclusively the riding strips 20, 20 are shifted laterally so as to allow the articles A, A to free fall through grid fingers in a funnel portion 26 of the grid structure in accordance with the conventional practice. In a typical cycle for such an apparatus the articles are loaded into the grid as suggested in FIG. 2 until a full pattern or group of articles is detected at which time the line brakes are set to permit the group of articles in the grid to be dropped into the awaiting packing case. Lift table 24 will have raised the case C upwardly and the riding strips 20 provided for this purpose in a conventional shifting grid will permit the articles to be gravity fed into the packing case, following which the case is lowered, and the riding strips shifted back to permit a second slug of articles to be loaded, and another case positioned on the lift table 24** to begin a second cycle.

It should be noted that in a conventional packer the infeed conveyor is continuously operated at a single speed such that the articles A, A are held back against the line pressure generated by the infeed conveyor until the time in the cycle for loading of the articles. The present invention relates to a unique drive unit 30 for the infeed conveyor 10 such that release of the line brakes 16 at a point in the cycle, illustrated by the line of FIG. 1 in FIG. 4, causes a speed pulse to be imposed on the infeed conveyor 10 as depicted schematically by the line S in FIG. 4. More particularly, the normal speed of the infeed conveyor is indicated generally by the line so labeled B in FIG. 4 and the speed pulse S is in the form of a sine curve generated by a variable speed drive unit associated with the drive means for the infeed conveyor 10 as shown in detail in FIGS. 5 and 6. It should be noted that the shape of the speed pulse S can be varied by removing a single part from the drive unit 30 illustrated in FIGS. 5 and 6 and replacing that part with a part or sprocket of different geometry in order to lengthen the speed pulse as suggested by the broken line S' in FIG. 4. Means is also provided, and will be disclosed, such that the maximum speed of the pulse S or S' can also be varied by varying the offset X in the variable speed drive unit to be described (reference FIG. 7).

Turning now to a more complete description of the drive unit 30 for operating the infeed conveyor 10, and more particularly for driving the shaft 32 associated with the downstream end of the infeed conveyor 10, a motor M is adapted to drive the infeed conveyor 10 at a predetermined normal speed through a speed reducing unit 34, sprocket assembly 38, drive chain 40, and sprocket 42 provided on infeed conveyor shaft 32. The speed of shaft 36 associated with reducing unit 34 is such that the infeed conveyor is driven at normal speed dictated by the size and shape of articles to be packaged, and by the size of the charge of the slug of articles to be fed into the grid 12. This normal speed is indicated graphically in FIG. 4 by the horizontal base line B. Thus, during the major portion of the apparatus cycle motor M drives infeed conveyor 10 through reducing unit 34 and its associated output shaft 36 through sprocket 38 chain 40 and sprocket 42 provided for this purpose on the infeed conveyor drive sprocket shaft 32. The sprocket assembly 38 includes a built in one-way clutch, indicated generally at 39, and said clutch is preferably in the form of cylindrical roller bearings adapted to continuously drive the infeed conveyor in the desired direction but to provide for increased speed of the infeed conveyor above the normal speed B when such increased speed is desired and achieved through the mechanism to be described.

Figure 6:
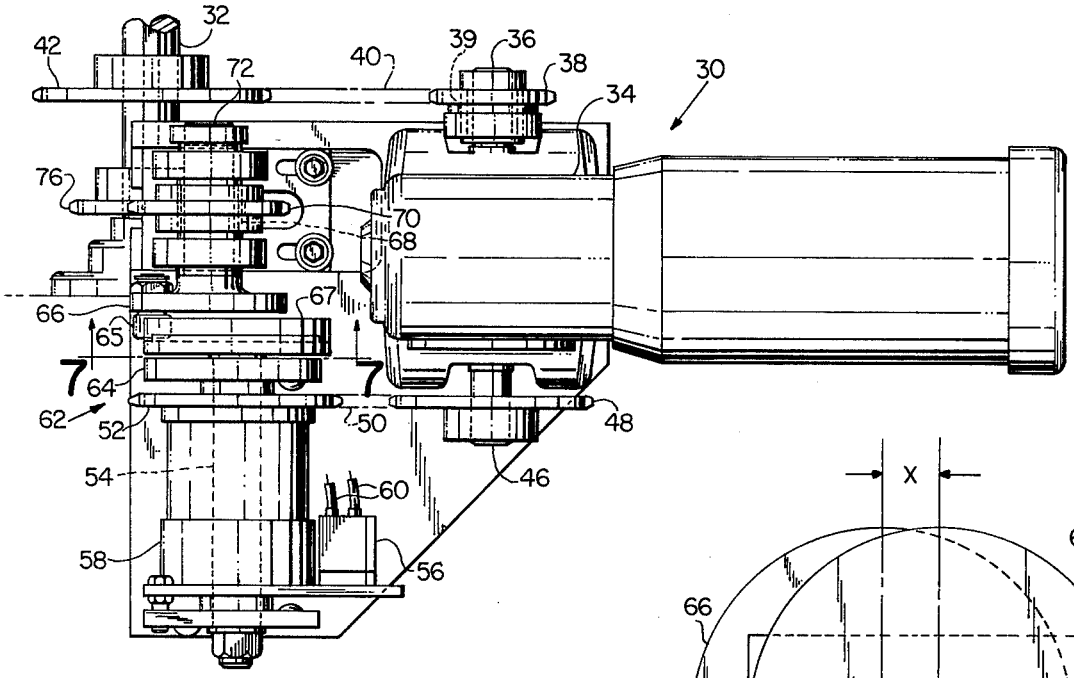
FIG. 6 is a plan view of the drive unit of FIG. 5.
Figure 7:
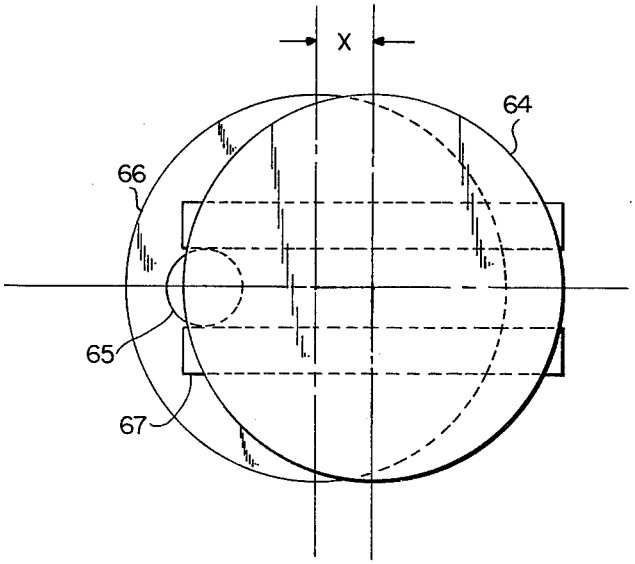
FIG. 7 is a schematic view of the variable speed drive unit taken in vertical section generally on the line 7—7 of FIG. 6.

As best shown in FIG. 6 the speed reducing unit 34 also has a secondary output shaft 46, which may rotate at the same speed as the shaft 36, and continuously drives sprocket 48 chain 50 and sprocket assembly 52. Shaft 54 associated with sprocket assembly 52 can be selectively rotated through a single revolution clutch 58 whenever an electric signal is provided at solenoid 56 associated with the hub assembly for sprocket 52. Sprocket 52 is coupled to shaft 54 through the single revolution clutch 58, which clutch is set to achieve a single revolution of shaft 54 in response to an electric signal at the lines 60 associated with solenoid 56.

Shaft 54 comprises the input side of a variable speed drive unit, indicated generally at 62 in FIG. 6. The input side of this unit 62 comprises a slotted bar provided on disc 64 such that a cam follower roller 65, provided on disc 66, can achieve a desired speed variation or pulse S. The magnitude of this speed pulse S is dictated by the offset X between the axes of rotation of cam follower 65 and the slotted bar 67, and the time width of this pulse is determined by the relative diameter of a sprocket assembly 70 provided on the output shaft 72 of variable speed drive units 62. As shown, sprocket assembly 70 is so sized as to achieve the pulse width shown at S in solid line in FIG. 4. However, by replacing sprocket 70 with a sprocket of larger diameter one can achieve a widening of the speed pulse to that shown in broken lines in Figure and indicated generally at S' in that view. Chain 74 couples sprocket assembly 70 to the drive shaft 32 associated with the infeed conveyor through a sprocket 76 provided for this purpose on the shaft 32.

Sprocket assembly 70, like that described above with reference to the normal drive sprocket 38, includes a one-way clutch assembly 68 within its hub such that drive shaft 32 associated with the infeed conveyor 10 is adapted to continuously operate in the desired direction and at the desired normal speed B without interference with the output shaft 72 associated with the variable speed drive unit 62 as a result of the overrunning clutch feature provided in the sprocket assembly 70. However, when output shaft 72 of variable speed drive unit 62 is increased above the level B shown graphically in FIG. 4, sprocket 70 will drive sprocket 76 and clutch mechanism 39 in sprocket assembly 38 will serve to overrun the normal input to the infeed conveyor permitting the speed pulse geometry described above.

Figure 5:
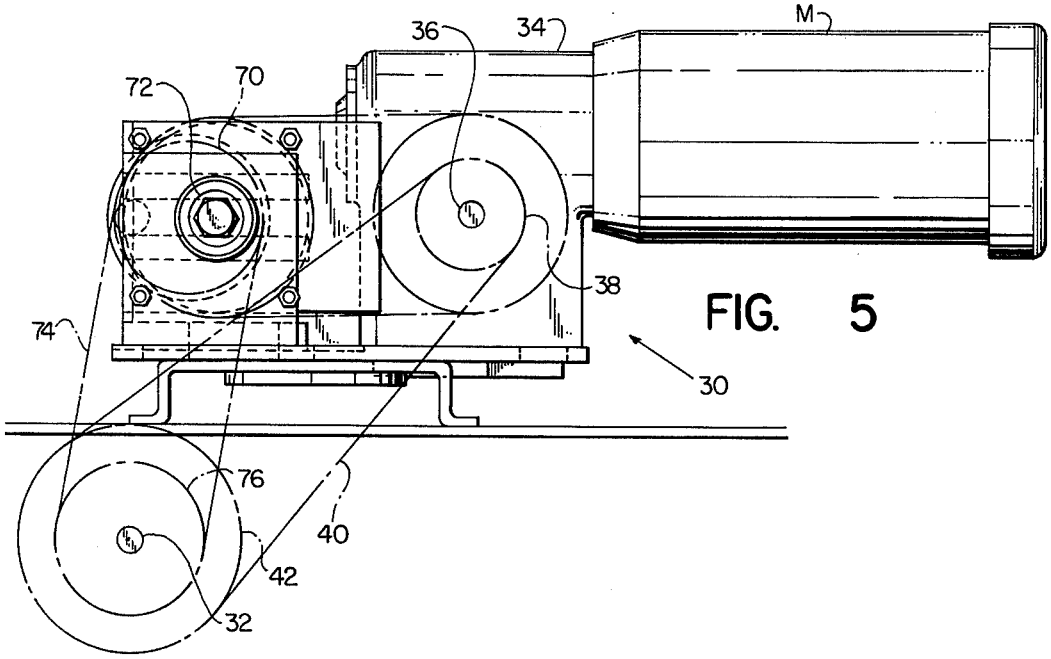
FIG. 5 is a side elevational view of the drive unit illustrated schematically in FIGS. 1–3 for achieving the speed pulse illustrated in the apparatus cycle of FIG. 4.

As mentioned above replacement of the sprocket assembly 70 will permit variation in the shape of the speed pulse as suggested in FIG. 4 as S and S'. In order to vary the maximum height of the speed pulse the offset X between the input shaft 54 and the output shaft 72 of the variable speed drive unit 62 must be achieved. With an offset X of the magnitude indicated, a three fold increase in speed is achieved. With no offset no speed pulse would be achieved. Correspondingly with a somewhat larger offset than that shown in the geometry of FIG. 7 a higher peak can be achieved for the speed pulse of FIG. 4. As mentioned above, the type of articles being handled, together with the size of the charge or slug of articles being deposited in the case will determine the geometry of the speed pulse to be chosen in a particular situation. It should also be noted that the articles A, A are of course stationary as the infeed conveyor 10 moves beneath the articles in the condition shown in FIG. 1, that is with the line brakes set. In this condition the relative speed differential, between the infeed conveyor 10 and the stationary articles A, is represented by the dimension delta V in FIG. 4. As the line brakes are released and the articles allowed to move into the grid 12 solenoid 56 initiates speed pulse S such that the articles are accelerated generally on a line such as indicated at delta S in FIG. 4 with the result that the speed of the articles will be matched to that of the accelerating infeed conveyor 10 to track the major portion of the speed pulse S. After the speed pulse peak has been passed, and the articles decelerated back to the normal speed B of infeed conveyor 10 it will be apparent that the engagement between the endmost article in the grid 12 and the lane detector 22 will occur at no greater speed differential than the delta V mentioned previously. The speed pulse width is such that the infeed conveyor 10 will have returned to the normal speed B prior to the time at which the endmost article in the line engages the lane detector 22 in the grid 12.

I claim:

1. Apparatus for loading groups of articles into upwardly open packing cases, and comprising in combination an infeed conveyor for feeding articles in a downstream direction, means for selectively holding back articles on said infeed conveyor, a grid downstream of said infeed conveyor for receiving articles when said grid is in one condition, said grid capable of depositing grouped articles into an upwardly open packing case when in a second condition, drive means for operating said infeed conveyor at a normal speed, a variable speed drive unit having an output shaft, one-way clutch means coupling said output shaft to said infeed conveyor, said variable speed drive unit having an input shaft coupled to said drive means, a single revolution clutch coupling said drive means to said variable speed drive input shaft to selectively couple said variable speed drive output shaft to said infeed conveyor for one revolution of said variable speed input shaft, a second one-way clutch means coupling said drive means to said infeed conveyor so that the latter can be selectively driven by said variable speed drive output shaft, and means responsive to release of said article holdback means to cause said single revolution clutch to so couple said variable speed drive output to said infeed conveyor during the cycle of operation of the apparatus.

2. Apparatus according to claim 1 wherein said variable speed drive unit produces a speed pulse having a magnitude which can be continuously varied from zero to at least three times the said normal speed of said infeed conveyor.

3. Apparatus according to claim 2 wherein said second one-way clutch means comprises a removable means replaceable by a third clutch means to vary the width of said speed pulse.

4. Apparatus according to claim 3 wherein said means responsive to release of said article holdback means comprises a solenoid selectively connected to said single revolution clutch and deriving an electrical signal from said holdback means indicative of the latter's condition.

* * * * *